US010760193B2

(12) United States Patent
Balinski et al.

(10) Patent No.: US 10,760,193 B2
(45) Date of Patent: Sep. 1, 2020

(54) METHOD FOR REAL TIME DETERMINATION DURING LOADING OF VOLUMETRIC LOAD SIZE IN A LAUNDRY TREATING APPLIANCE

(71) Applicant: WHIRLPOOL CORPORATION, Benton Harbor, MI (US)

(72) Inventors: Barbara A. Balinski, Saint Joseph, MI (US); Jason L. Barr, Lawton, MI (US); Andrew Leitert, Eau Claire, MI (US); Karl David McAllister, Stevensville, MI (US); James A. Oskins, Saint Joseph, MI (US); Matthew J. Quock, Saint Joseph, MI (US); Jamal O. Wilson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 231 days.

(21) Appl. No.: 15/698,090

(22) Filed: Sep. 7, 2017

(65) Prior Publication Data

US 2018/0010286 A1 Jan. 11, 2018

Related U.S. Application Data

(63) Continuation of application No. 13/959,874, filed on Aug. 6, 2013, now abandoned, which is a (Continued)

(51) Int. Cl.

| | |
|---|---|
| ***D06F 34/18*** | (2020.01) |
| ***D06F 33/00*** | (2020.01) |
| ***D06F 34/22*** | (2020.01) |

(52) U.S. Cl.
CPC ..... *D06F 34/18* (2020.02); *D06F 33/00* (2013.01); *D06F 34/22* (2020.02); *D06F 2202/10* (2013.01); *D06F 2216/00* (2013.01)

(58) Field of Classification Search
CPC ..... D06F 39/003; D06F 2216/00
See application file for complete search history.

(56) References Cited

U.S. PATENT DOCUMENTS

| | | | |
|---|---|---|---|
| 3,470,718 | A | 10/1969 | Scourtas |
| 6,169,964 | B1 | 1/2001 | Aisa et al. |

(Continued)

FOREIGN PATENT DOCUMENTS

| | | | |
|---|---|---|---|
| CN | 1683642 | A | 10/2005 |
| EP | 0051491 | A1 | 5/1982 |

(Continued)

OTHER PUBLICATIONS

Machine Translation of KR20050050260A (May 2005).

*Primary Examiner* — Spencer E Bell
(74) *Attorney, Agent, or Firm* — McGarry Bair PC

(57) ABSTRACT

A method of operating and a laundry treating appliance, including a rotatable drum at least partially defining a treating chamber into which laundry may be placed for treatment according to a cycle of operation, a processor programmed to at least as the laundry is being placed in the treating chamber, at least one of measure, sense, analytically determine, estimate, or receive as an input a first load size of the laundry in the treating chamber to define a determined first load size and select at least one of a color or an intensity corresponding to the determined first load size to define a first light setting.

18 Claims, 15 Drawing Sheets

Related U.S. Application Data continuation-in-part of application No. 13/209,475, filed on Aug. 15, 2011, now abandoned.

(56) References Cited

U.S. PATENT DOCUMENTS

| | | | | |
|---|---|---|---|---|
| 7,536,881 | B2 | 5/2009 | Lorenz et al. | |
| 2006/0190266 | A1 | 8/2006 | Tanigawa et al. | |
| 2007/0169281 | A1 | 7/2007 | Ha | |
| 2008/0256723 | A1 | 10/2008 | Kim et al. | |
| 2009/0106913 | A1 | 4/2009 | Suel, II et al. | |
| 2010/0205823 | A1 | 8/2010 | Ashrafzadeh et al. | |
| 2011/0062952 | A1* | 3/2011 | Smargiassi | D06F 37/20 324/226 |
| 2011/0113902 | A1 | 5/2011 | Lilie et al. | |
| 2011/0138541 | A1 | 6/2011 | Brockman et al. | |
| 2012/0298427 | A1 | 11/2012 | Bringewatt et al. | |
| 2012/0312055 | A1 | 12/2012 | Fagstad et al. | |

FOREIGN PATENT DOCUMENTS

| | | | |
|---|---|---|---|
| EP | 1498705 | A1 | 1/2005 |
| GB | 2225030 | A | 5/1990 |
| GB | 2247250 | A | 2/1992 |
| GB | 2269395 | A | 2/1994 |
| JP | 2055091 | A | 2/1990 |
| JP | 2071790 | A | 3/1990 |
| JP | 2185291 | A | 7/1990 |
| JP | 3242196 | A | 10/1991 |
| JP | 5220300 | A | 8/1993 |
| JP | 5317589 | A | 12/1993 |
| JP | 6267540 | A | 9/1994 |
| JP | 2004313416 | A | 11/2004 |
| KR | 970001335 | B1 | 2/1997 |
| KR | 20020022448 | A | 3/2002 |
| KR | 20050050260 | A | 5/2005 |
| KR | 20070081879 | A | 8/2007 |
| KR | 20080076313 | A | 8/2008 |
| WO | 2009083760 | A1 | 7/2009 |
| WO | 2011080074 | A1 | 7/2011 |

* cited by examiner

Laundry Load Mass/Volume Based Actions

| LOAD EXAMPLE | LOAD MASS | LOAD VOLUME | WATER LEVEL [1] | DETERGENT RECOMMENDATION [2] | LOAD SIZE DISPLAY [3,4] |
|---|---|---|---|---|---|
| Exercise attire (shirt and shorts) | Low | Low | Minimum | Minimum | Low |
| Comforter | Low | Low | Average | Average | Mass sensing alone shows "low"; subject method correctly indicates "high" |
| Mixed Laundry - 1 basket | Medium | Low | Average | Average | Low |
| Fluffy dry towels | Medium | High | Maximum | Maximum | High |
| Wetted towels (beach towels, pet bath towels) | Large | Low | Average | Average | Mass sensing alone shows "high"; subject method correctly indicates "low" |
| Mixed Laundry - 2 baskets | Large | High | Maximum | Maximum | High |
| Mixed Laundry - 3 baskets forced into drum | Overload | High | Maximum | Maximum | Warning indicator |
| Problematic loads for consumer to preceive are italicized | Load mass depends on drum volume; varies by platform | If garments at top front of drum, then high volume, otherwise low volume | Set according to load size; function of mass and volume | Based on water level | |

[1] Automatically set by machine
[2] Graphical display and/or automatic dosing
[3] Indicator LED(s) or graphics
[4] Function primarily of volume rather than mass

FIG. 18

METHOD FOR REAL TIME DETERMINATION DURING LOADING OF VOLUMETRIC LOAD SIZE IN A LAUNDRY TREATING APPLIANCE

CROSS-REFERENCE TO RELATED APPLICATION

This application is a continuation of U.S. patent application Ser. No. 13/959,874, filed Aug. 6, 2013, which is a continuation-in-part of U.S. Patent Application Publication No. US 2013/0042416 A1, published Feb. 21, 2013, all of which are incorporated herein by reference in their entirety.

BACKGROUND

Laundry treating appliances, such as a washing machine in which a drum defines a treating chamber for receiving and treating a laundry load, may implement cycles of operation that may vary according to the size of the laundry load in the drum. The size of the laundry load may be manually input by a user through a user interface or may be automatically determined by the washing machine during a cycle of operation. With manual input, the user may overestimate or underestimate the load size, leading to a treating performance that may be less than optimal.

Known washing machines may be programmed to perform one of several methods to automatically determine load size during a cycle of operation, such as by correlating an output of the motor that drives the drum. In such a case, a load size indicated by the washing machine may be treated by a user as inaccurate based upon the user's observations of the load in the drum. In response, the user may adjust a treating cycle to reflect the user's conclusion that the load size is other than the size indicated by the washing machine. This also may lead to a treating performance that may be less than optimal.

SUMMARY

An aspect of the present disclosure relates to a laundry treating appliance, including a rotatable drum at least partially defining a treating chamber into which laundry may be placed for treatment according to a cycle of operation, a processor programmed to at least as the laundry is being placed in the treating chamber, at least one of measure, sense, analytically determine, estimate, or receive as an input a first load size of the laundry in the treating chamber to define a determined first load size and select at least one of a color or an intensity corresponding to the determined first load size to define a first light setting and control a light source to illuminate with the selected first light setting.

Another aspect of the present disclosure relates to a method of operating a laundry treating appliance having a rotatable drum at least partially defining a treating chamber into which laundry may be placed for treatment according to a cycle of operation, the method comprising, determining, via a processor, a load size of the laundry in the treating chamber as the laundry is being placed in the treating chamber, selecting, via the processor, at least one of a color or an intensity corresponding to the determining the load size to define a light setting and controlling a light source to illuminate with the selected light setting.

BRIEF DESCRIPTION OF THE DRAWINGS

In the drawings:

FIG. 18 is a tabular summary of laundry load items, load mass, and load volume for selected laundry load types, wash liquid levels, and detergent levels.

DETAILED DESCRIPTION

Figure 1:
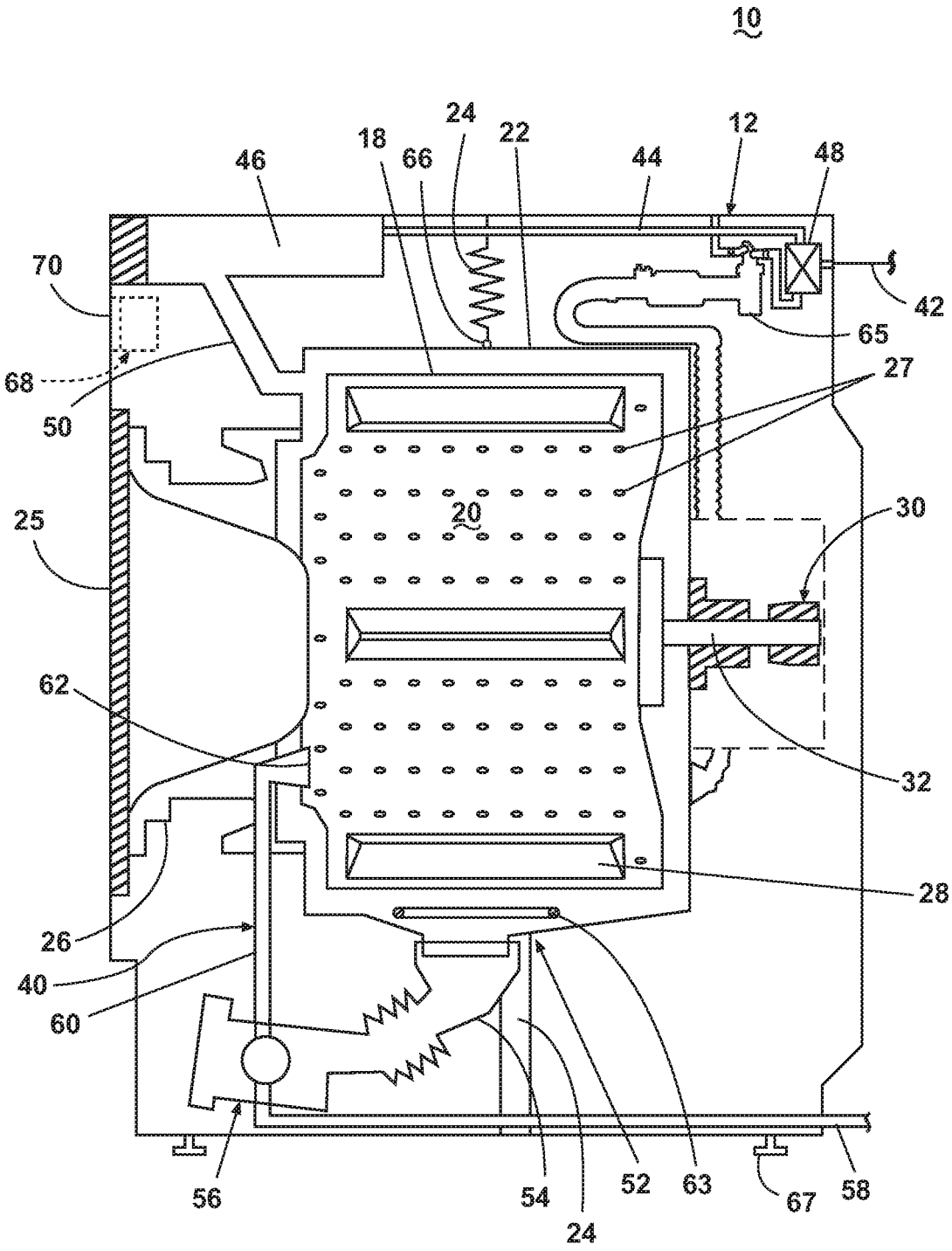
FIG. 1 is a sectional view of a laundry treating appliance according to one embodiment of the invention.

FIG. 1 illustrates a laundry treating appliance in the form of a horizontal-axis washing machine 10 according to one embodiment of the invention. The laundry treating appliance may be any machine that treats articles such as clothing or fabrics. Non-limiting examples of the laundry treating appliance may include a vertical washing machine; a combination washing machine and dryer; and a refreshing/revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum may rotate about an axis inclined relative to the horizontal axis. Vertical axis and horizontal axis machines are best differentiated by the manner in which they impart mechanical energy to the fabric articles. In vertical axis machines, a clothes mover, such as an agitator, auger, impeller, to name a few, moves within a drum to impart mechanical energy directly to the clothes or indirectly through wash liquid in the drum. The clothes mover may typically be moved in a reciprocating rotational movement. The illustrated exemplary washing machine of FIG. 1 is a horizontal axis washing machine.

The washing machine 10 may include a housing 12, which may be a cabinet or a frame to which decorative panels are mounted. A rotatable drum 18 may be disposed within an interior of the housing 12 and may at least partially define a treating chamber 20 for treating laundry. The rotatable drum 18 may be mounted within an imperforate tub 22, which may be suspended within the housing 12 by a resilient suspension system 24. Both the tub 22 and the drum 18 may be selectively closed by a door 25. A bellows 26 couples an open face of the tub 22 with the housing 12, and the door 25 seals against the bellows 26 when the door 25 closes the tub 22. The drum 18 may include a plurality of perforations 27, such that liquid may flow between the tub 22 and the drum 18 through the perforations 27.

The drum 18 may further include a plurality of baffles 28 disposed on an inner surface of the drum 18 to lift fabric items forming a laundry load contained in the laundry treating chamber 20 while the drum 18 rotates. A motor 30 may be coupled to the drum 18 through a drive shaft 32 for selective rotation of the treating chamber 20 during a cycle of operation. It may also be within the scope of the invention for the motor 30 to be coupled with the drive shaft 32 through a drive belt for selective rotation of the treating chamber 20. The motor 30 may rotate the drum 18 at multiple or variable speeds in either rotational direction.

While the illustrated washing machine 10 includes both the tub 22 and the drum 18, with the drum 18 defining the laundry treating chamber 20, it is within the scope of the invention for the washing machine 10 to include only one receptacle, with the receptacle defining the laundry treating chamber for receiving a laundry load to be treated.

A liquid supply and recirculation system 40 may also be included in the washing machine 10. Liquid, such as water, may be supplied to the washing machine 10 from a water supply 42, such as a household water supply. A supply conduit 44 may fluidly couple the water supply 42 to the tub 22 and a treating chemistry dispenser 46. The supply conduit 44 may be provided with an inlet valve 48 for controlling the flow of liquid from the water supply 42 through the supply conduit 44 to the treating chemistry dispenser 46. The treating chemistry dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of a cycle of operation.

A liquid conduit 50 may fluidly couple the treating chemistry dispenser 46 with the tub 22. The liquid conduit 50 may couple with the tub 22 at any suitable location on the tub 22 and is shown as being coupled to a front wall of the tub 22 for exemplary purposes. The liquid that flows from the treating chemistry dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid. While the recirculation inlet 62 is illustrated as being located at a lower portion of the tub 22 it is contemplated that it may be located in alternative locations including an upper portion of tub 22.

Additionally, the liquid supply and recirculation system 40 may differ from the configuration shown in FIG. 1, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid. Further, the liquid supply and recirculation system 40 need not include the recirculation portion of the system or may include other types of recirculation systems.

A heater, such as sump heater 63 or steam generator 65, may be provided for heating the liquid and/or the laundry load. The sump heater 63 is illustrated as a resistive heating element. The sump heater 63 may be used alone or in combination with the steam generator 65 to heat the liquid and/or the laundry load.

One or more sensors 66 may be positioned in a suitable location in the washing machine 10 for detecting the amount of laundry placed in the treating chamber 20. By way of non-limiting example, the amount of laundry in the treating chamber may be determined based on the weight of the laundry and/or the volume of laundry in the treating chamber. Thus, one or more sensors 66 may output a signal indicative of the weight of the laundry load in the treating chamber 20. Alternatively, one or more sensors (not shown) may output a signal indicative of the volume of the laundry load in the treating chamber 20, as hereinafter described. The sensors may be a type suitable for measuring the weight or volume of laundry in the treating chamber 20.

Non-limiting examples of sensors 66 for measuring the weight of the laundry may include load volume, pressure, or force transducers which may include, for example, load cells and strain gauges. The sensors 66 may be operably coupled to the suspension system 24 to sense the weight borne by the suspension system 24, including the weight of the laundry loaded into the treating chamber 20, the weight of the drum, and the weight of the tub. The signals from the sensors 66 may be conditioned in the controller 68 to indicate the weight of the laundry in the treating chamber 20.

Alternatively, the washing machine 10 may have one or more pairs of feet 67 supporting the housing 12 on a floor with a weight sensor (not shown) operably coupled to at least one of the feet 67. The sensed weight borne by that foot 67 may correlate to the weight of the laundry loaded into the treating chamber 20. Several weight sensors may be operably coupled to each foot 67 to obtain a more accurate indication of the weight of the laundry loaded into the treating chamber 20. Thus, it is contemplated that the one or more weight sensors may be applied in either tension or compression to measure the weight of the laundry in the treating chamber 20.

An infrared (IR) or optical-based sensor may be used to determine the volume of laundry in the treating chamber 20, as hereinafter described.

A controller 68 may be located within the housing 12 for controlling the operation of the washing machine 10 to implement one or more cycles of operation, which may be stored in a memory of the controller 68. Examples, without limitation, of cycles of operation include: wash, heavy duty wash, delicate wash, quick wash, refresh, rinse only, and timed wash. A user interface 70 may be included with the housing 12, and may include one or more knobs, switches, displays, and the like for communicating with the user, such as to receive input and provide output.

Figure 2:
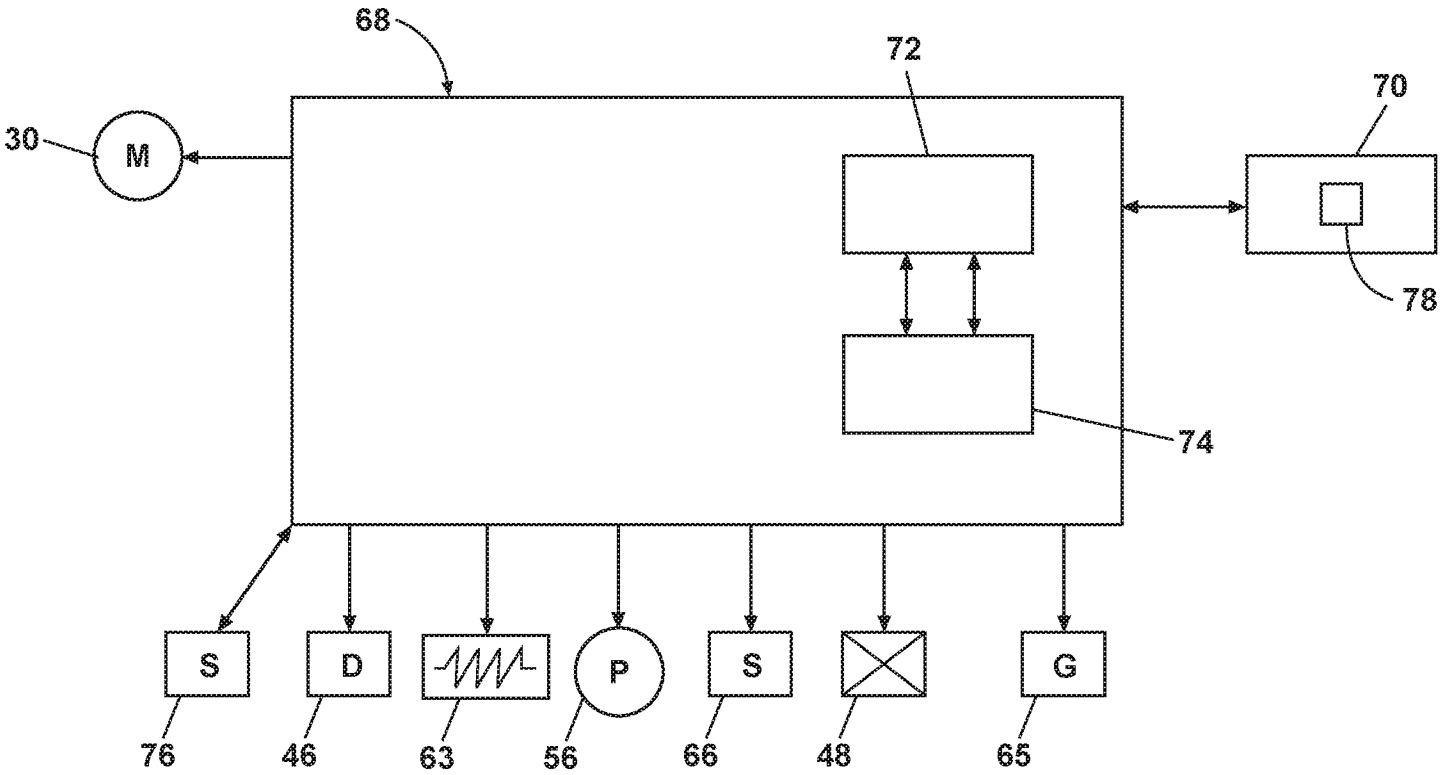
FIG. 2 is a schematic view of a controller of the laundry treating appliance of FIG. 1.

As illustrated in FIG. 2, the controller 68 may be provided with a memory 72 and a central processing unit (CPU) 74. The memory 72 may be used for storing the control software in the form executable instructions that may be executed by the CPU 74 in executing one or more cycles of operation using the washing machine 10 and any additional software. The memory 72 may also be used to store information, such as a database or table, and to store data received from one or more components of the washing machine 10 that may be communicably coupled with the controller 68 as needed to execute the cycle of operation.

The controller 68 may be operably coupled with one or more components of the washing machine 10 for communicating with and controlling the operation of the component to complete a cycle of operation. For example, the controller 68 may be coupled with the one or more sensors 66 for receiving the output of the sensors 66 indicative of the amount of laundry, the motor 30 for controlling the direction and speed of rotation of the drum 18, and the pump 56 for draining and recirculating wash water in the sump 52. The controller 68 may also be operably coupled to the inlet valve 48, the steam generator 65, the sump heater 63, and the treatment dispenser 46 to control operation of the component for implementing the cycle of operation. The controller 68 may also receive input from one or more sensors 76 known in the art. Non-limiting examples of sensors that may be communicably coupled with the controller 68 include: a treating chamber temperature sensor, a moisture sensor, a drum position sensor, a motor torque sensor, a motor speed sensor, a level sensor, etc. By way of non-limiting example, a level sensor 76 may output a signal indicative of a levelness of the laundry treating appliance and/or the treating chamber to the controller 68. Such a level sensor may include any suitable type of sensor including a bubble sensor, which may use a leveling bubble to indicate the levelness of the laundry treating appliance and/or the treating chamber to the controller 68. The controller 68 may also be operably coupled with the user interface 70 for receiving user selected inputs and communicating information with the user.

The user interface 70 is schematically illustrated as including an indicator 78. The indicator 78 may indicate to a user when laundry in the treating chamber 20 satisfies a predetermined amount threshold correlating to an optimally filled treating chamber 20 for a specific selected cycle. The indicator 78 may allow the user to see how much laundry may be needed to optimally fill the washing machine 10 for a selected cycle so that optimal cleaning of the load may be obtained. The indicator 78 may alternatively indicate to a user which cycles are selectable based on the laundry loaded in the treating chamber 20. The indicator 78 may alternatively be located elsewhere on the washing machine 10.

Such alternative locations may include on the housing 12 near the door 25, on the bellows 26, or on the door 25. The controller 68 may be capable of sending wireless signals to a portable device such that the user may receive indications through the device. The washing machine 10 may be linked to a smartphone, which may act as the indicator and may indicate information to a user as described with respect to the indicator 78 above. Thus, as the amount of laundry in the washing machine 10 changes, the display on the smartphone or portable device may change. The smartphone or portable device may also send wireless signals to the washing machine 10 such that it may act as the user interface for the washing machine 10. The user may select an option on the smartphone and the washing machine 10 may receive such selections and be operated accordingly. However, the remainder of this description will describe the indicator 78 as being located on the user interface 70.

Figure 3:
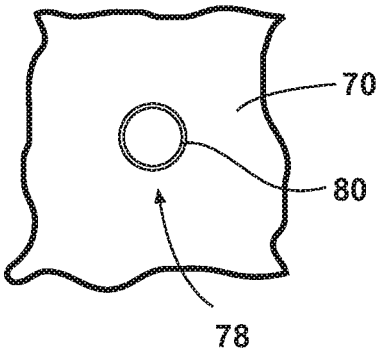
FIGS. 3-8 are partial front views of embodiments of exemplary user interfaces of the laundry treating appliance of FIG. 1.

FIG. 3 illustrates a first exemplary portion of a user interface 70 having an indicator 78 in the form of a laundry fill indicator. It is illustrated that the indicator 78 may have a simple system which indicates only two different conditions of optimally loaded/filled or overfilled for the cycle of operation selected by the user. More specifically, the indicator 78 has been illustrated as a single light emitting diode (LED) 80 which may turn off or on to signify the two conditions. Alternatively, the LED 80 may change color to signify a particular status. For example, led 80 may be illuminated with a first color, such as green, to inform a user that the treating chamber 20 is optimally filled for the selected cycle, and may be illuminated with a second color, such as red, to inform a user that the treating chamber is overfilled for the selected cycle. The LED 80 may remain unlit if the amount of the laundry load in the treating chamber 20 is underfilled and has not reached the optimally filled range for the selected cycle. It has been contemplated that an audible noise may be combined with the LED 80 to additionally alert the user that the treating chamber 20 is overfilled.

Figure 4:
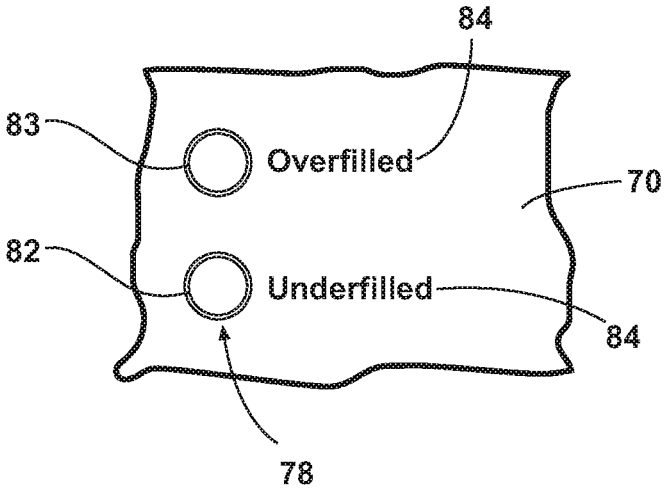

FIG. 4 illustrates that, alternatively, multiple LEDS 82, 83 and indicia 84 may be used to indicate the two different conditions of optimally loaded or overfilled for the cycle of operation selected by the user. For example, LED 82 may be illuminated with a color such as green to inform a user that the treating chamber 20 may be in an optimally filled range for the selected cycle. If the load amount is below such an optimally filled threshold the LED 82 may remain unlit to indicate that the optimal load amount has not yet been reached. Further, LED 83 may be illuminated with the same color or with a second color, such as red, to inform the user that the treating chamber 20 is overfilled for the selected cycle. It has been contemplated that an audible noise may be combined with the LED to additionally alert the user that the treating chamber 20 is overfilled.

Figure 5:
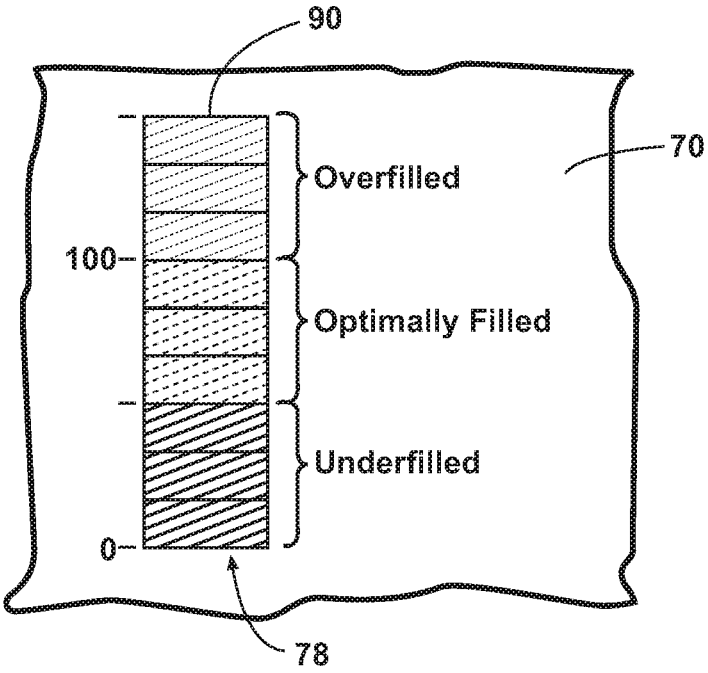

FIG. 5 illustrates that the indicator 78 may be a range indicator or graduated scale 90 illustrating the filled condition. The scale 90 begins at zero, "0", but need not. It has also been illustrated as including a range beyond or greater than the filled condition, which may indicate to a user an overfilled condition for the selected cycle. The middle of the scale may indicate a filled threshold or expected optimal cleaning limit. If the user fills past this point, the display may extend beyond the threshold to the overfilled condition and perhaps turn red indicating that overfilling has occurred and cleaning performance will decrease. The scale 90 may give the user continuous feedback as the machine is filled.

Figure 6:
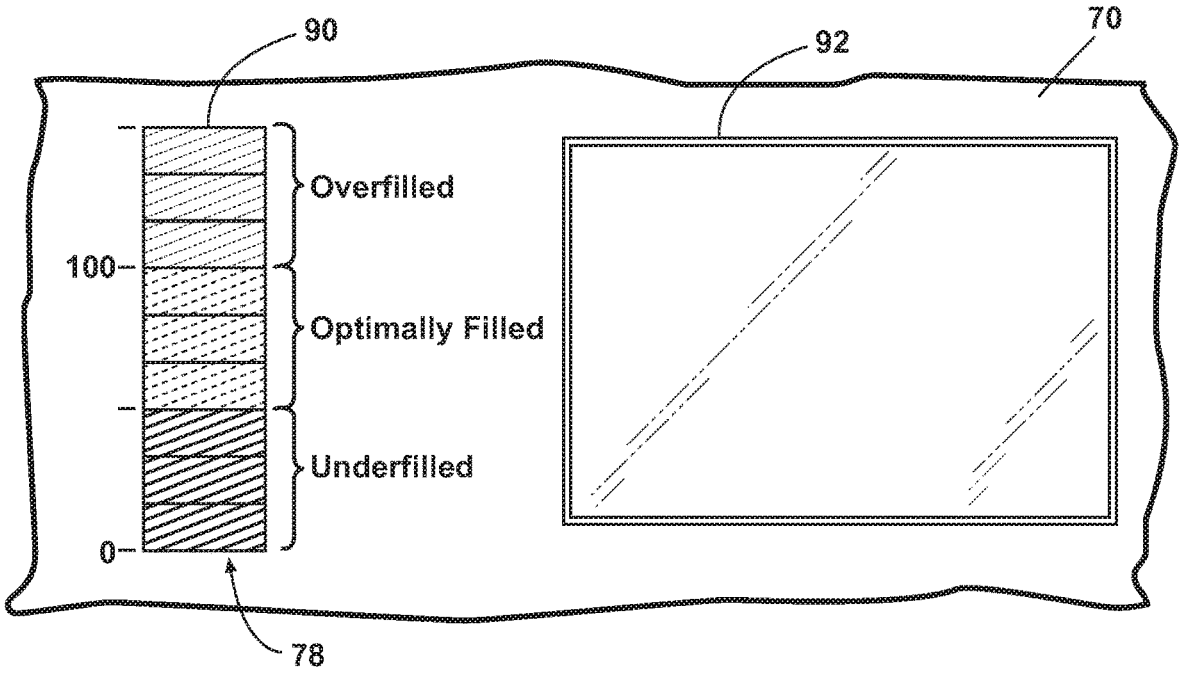

FIG. 6 illustrates that the user interface 70 may include a message provider 92 in addition to the indicator 78. The message provider 92 may provide a status message based on a first status indicator, and may then enhance the status message based on a second status indicator. For example, message provider 92 may provide a status message based on data regarding the amount of laundry in the treating chamber 20 such as the chamber is underfilled, optimally filled or under filled for the selected cycle. An additional message provider may then enhance the status message and indicate to the user estimated energy or water usage or usage savings of having a load that size. Alternatively, it has been contemplated that the LCD display may also be capable of indicating the filled or overfilled condition of the treating chamber, and thus may be used as the indicator and a separate indicator may be unnecessary.

Figure 7:
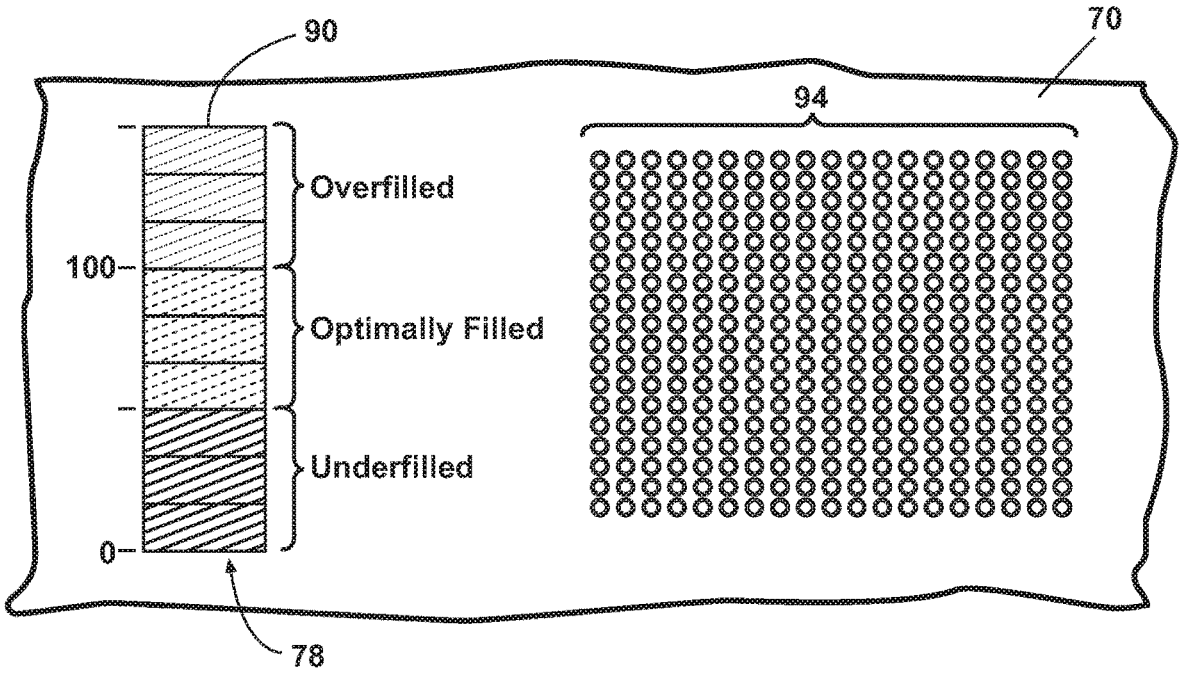

FIG. 7 illustrates a message provider 94 in the form of an array of LEDs. One or more of the LEDs may be illuminated, possibly with one or more different colors, in order to convey a message to the user regarding the selected cycle or the laundry loaded within the treating chamber 20. It has been contemplated that such an array of LEDS may be used as the single indicator to inform a user that the treating chamber 20 is in an optimally filled range.

Figure 8:
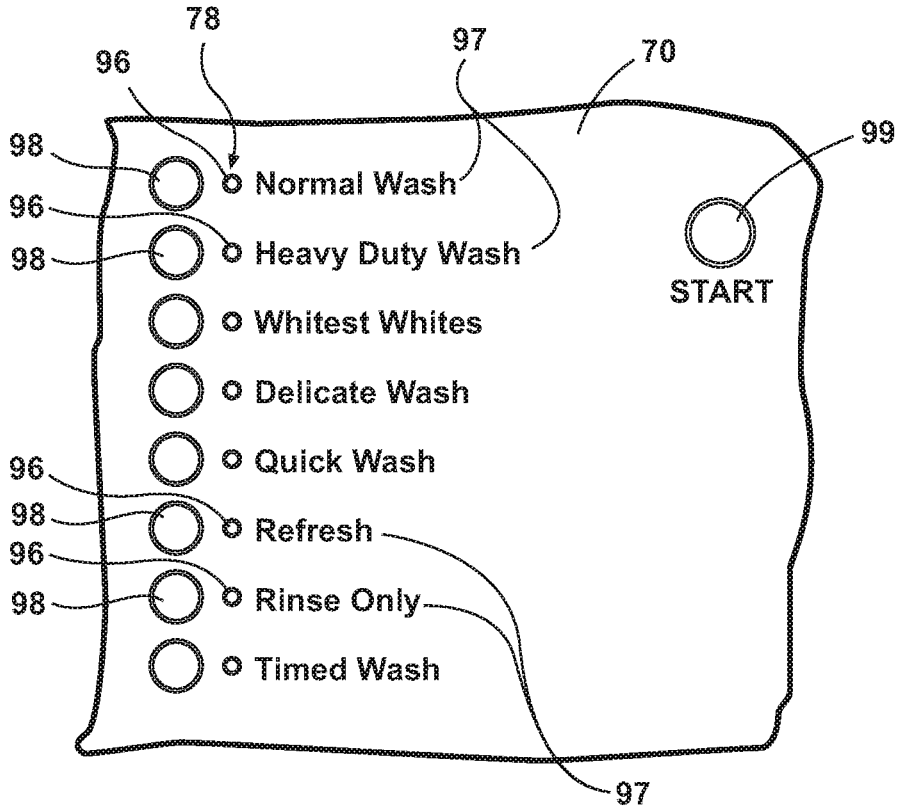

FIG. 8 illustrates that the indicator 78 may include various LEDs 96 to indicate to a user which cycles are selectable based on the laundry loaded in the treating chamber 20. More specifically, the indicator 78 may include an LED 96 located next to indicia 97 indicating each of the cycles of operation. LEDs 96 have been shown next to indicia 97 indicating wash, heavy duty wash, whitest whites, delicate wash, quick wash, refresh, rinse only, and timed wash cycles. The indicator 78 may visually communicate, through the LEDs 96, to the user when one or more of the cycles of operation are available for selection by the user based on the laundry loaded in the treating chamber 20. Each LED 96 may be illuminated as a first color if the cycle is available, as a second color if the cycle is not available, and a third color if the cycle is selected by a user. The different illumination colors may be achieved by use of a multi-color LED. In addition to or in place of different colors, different illumination intensities may be used to indicate the status. Alternatively, each LED 96 may be illuminated if the cycle is available for selection and remain un-illuminated if the cycle is not available for selection. The user may select a corresponding selection button 98 located beside the LED 96, which indicates an available cycle, so that the illuminated cycle may be selected. When a start button 99 is depressed, the LEDs 96 for the other available cycles may be turned off. The previously described washing machine 10 may be used to implement one or more embodiments of a method of the invention.

Figure 9:
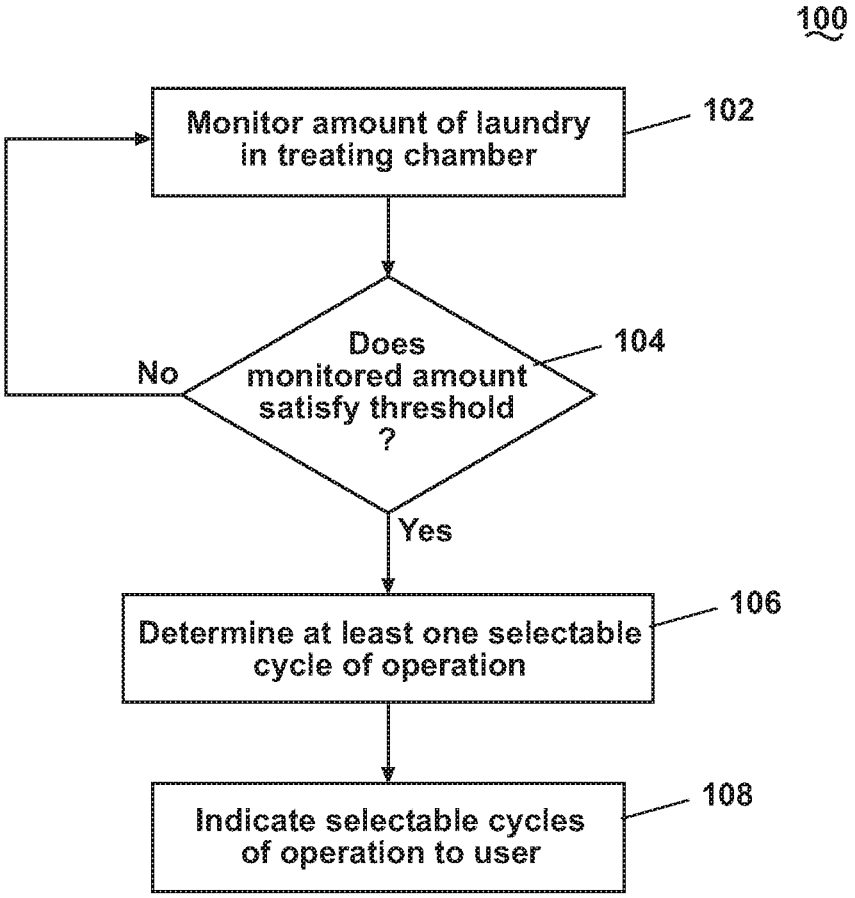
FIG. 9 is a flow chart of a method for determining selectable cycles of operation based on a determined load size in the laundry treating appliance of FIG. 1 and indicating the same to a user according to a second embodiment of the invention.

Referring now to FIG. 9, a flow chart of a method 100 for determining and indicating selectable cycles of operation based on a monitored load amount loaded into the laundry treating appliance according to a second embodiment of the invention is illustrated. The method 100 assumes that no fabrics have been loaded into the treating chamber 20 and that no user-selection of a cycle of operation has occurred prior to the start of the method 100. The method 100 may be initiated automatically when the door 25 is opened or when the user begins to place items within the treating chamber 20.

The method 100 begins at 102 where the controller 68 monitors the amount of fabric items or a laundry load within the treating chamber 20 when items are being loaded into the treating chamber 20. The amount monitored in the method 100 may be either a weight of the laundry loaded into the treating chamber 20 or a volume of the laundry loaded into the treating chamber 20. The controller 68 may monitor the amount by repeatedly sensing the amount of the laundry loaded into the treating chamber 20 during loading. More specifically, the controller 68 may receive a repeatedly output signal indicative of the amount of the laundry loaded in the treating chamber 20 from one or more amount sensors. Alternatively, the controller 68 may repeatedly sense the amount by sensing the change in amount of the treating chamber 20 during loading as determined from the output signal from one or more amount sensors.

At 104, the controller 68 may determine if the monitored amount satisfies a predetermined amount threshold. The controller 68 may accomplish this by comparing the monitored amount to a predetermined weigh threshold to see if the monitored amount satisfies the predetermined threshold. To do this, the controller 68 may compare the monitored amount, either continuously or at set time intervals, to the predetermined threshold value. The term "satisfies" the threshold is used herein to mean that the amount of the laundry within the treating chamber 20 satisfies the predetermined threshold, such as being equal to or greater than the threshold value. It will be understood that such a determination may easily be altered to be satisfied by a positive/negative comparison or a true/false comparison.

The predetermined threshold value may be determined experimentally and stored in the memory 72 of the controller 68. It has been contemplated that the predetermined amount threshold value may be a predetermined amount range and that the predetermined amount threshold may be satisfied when the monitored amount falls within the predetermined amount range. It has been contemplated that there may be multiple predetermined amount threshold values and that during the comparison it may be determined which of the multiple values is satisfied.

Thus, at 102 the controller 68 repeatedly receives the output from the amount sensor 66, which indicates the amount of the laundry loaded within the treating chamber 20, and at 104 compares it with a predetermined amount threshold stored in the memory 72 to determine when the amount of the laundry loaded into the treating chamber 20 satisfies the amount threshold. If the monitored amount does not satisfy the predetermined threshold, then the controller 68 returns to 102 where the controller 68 continues to monitor the amount of laundry within the treating chamber 20 and then compares the monitored amount to the predetermined amount threshold at 104 to determine if the threshold is satisfied. When it is determined at 104 that the monitored amount satisfies the predetermined threshold, then the controller 68 at 106 may determine one or more cycles of operation which may be optimally implemented for the laundry load located in the treating chamber 20. The controller 68 may have a table of cycles that may be optimally implemented for the predetermined amount threshold stored in its memory 72. The controller 68 may determine that only these cycles are selectable based on the monitored amount of the laundry load in the treating chamber 20.

Once it is determined which cycles of operation are selectable, the controller 68 may correspondingly activate an indicator 78 on the user interface 70 to indicate the one or more selectable cycles of operation. This may be done using any of the previously described methods.

A benefit of the method 100 is that the feedback provides the user with information regarding what cycles of operation are appropriate for the load that has been placed in the treating chamber 20. Such an indication provided to the user allows the user to optimally operate the washing machine 10 based on the load in the treating chamber 20. Such feedback gives additional information to the user so that the user does not have to estimate the load size or guess which cycles will provide optimal treating performance for the load.

Figure 10:
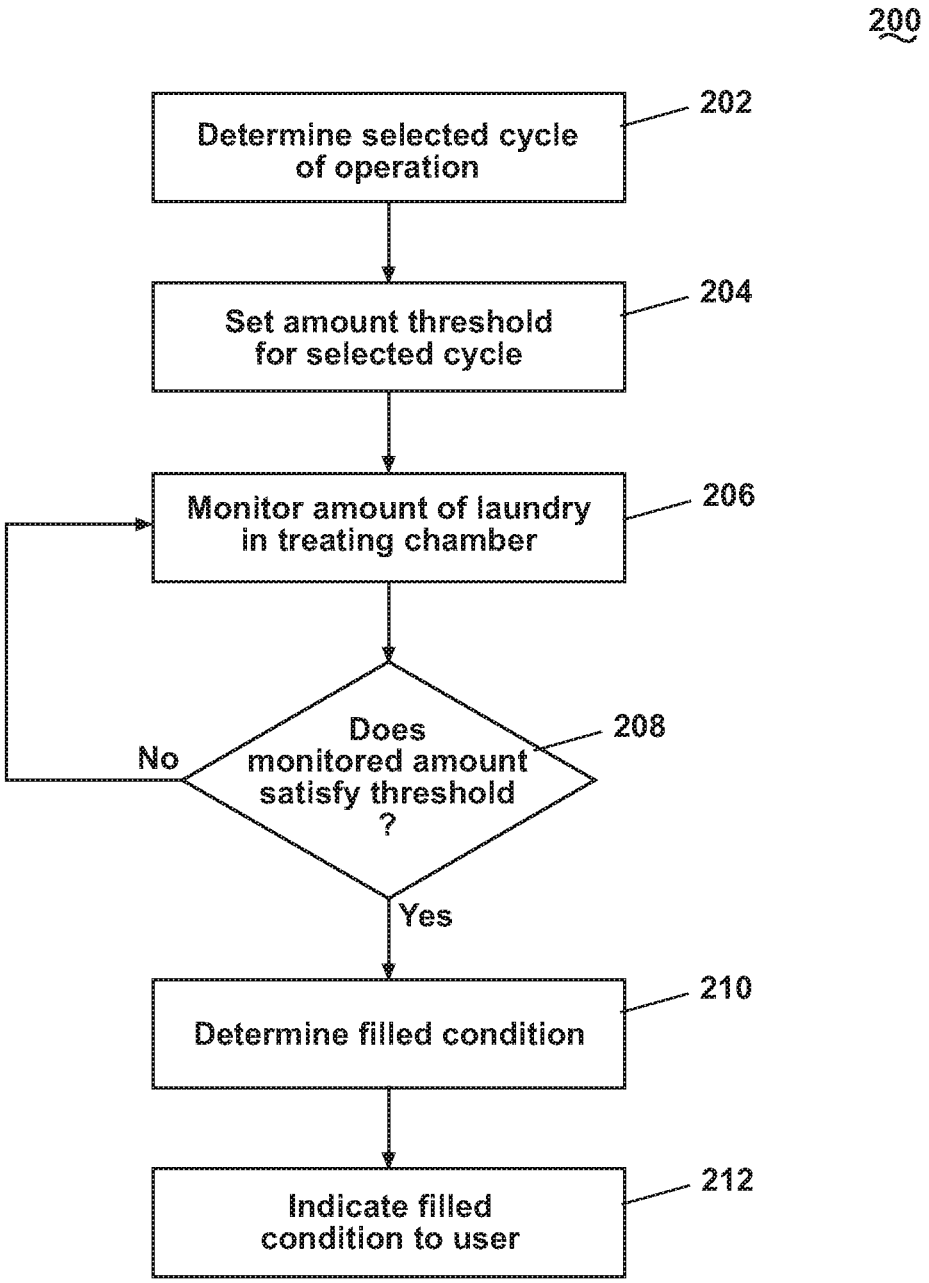
FIG. 10 is a flow chart of a method for determining a filled condition for a selected cycle of operation of the treating appliance of FIG. 1 and indicating the same to a user according to a third embodiment of the invention.

FIG. 10 is a flow chart of a method 200 for determining a filled condition for a selected cycle of operation of the treating appliance of FIG. 1 and indicating the same to a user according to a third embodiment of the invention. The method 200 assumes that no fabrics have been loaded into the treating chamber 20. The method 200 may be initiated automatically when the door 25 is opened or when the user selects a cycle of operation.

The method 200 begins at 202 where the controller 68 determines what cycle of operation has been selected by a user via the user interface 70. This may also include determining which, if any, cycle modifiers are optionally selected, such as a load color, and/or a fabric type. Examples of load colors are whites and colors. Examples of fabric types are cotton, silk, polyester, delicates, permanent press, and heavy duty.

At 204 the controller 68 may set an amount threshold for the selected cycle of operation. It is contemplated that the amount threshold may correlate to a weight threshold or a volume threshold based on the determined cycle of operation. The set amount threshold may be predetermined experimentally and stored in the memory 72 of the controller 68. The set amount threshold may include a predetermined value that is based on the determined cycle of operation and such a value may be satisfied when the monitored amount is equal to or greater that the predetermined amount value. Alternatively, the set amount threshold may include a predetermined amount range that is based on the determined cycle of operation and the predetermined amount threshold is satisfied when the monitored amount falls within the predetermined amount range. It has also been contemplated that for a selected cycle the controller 68 may set multiple predetermined amount threshold values or ranges correlating to a percentage (0%, 20%, etc.) of the optimal amount which may be provided in the treating chamber 20 for the selected cycle.

The method 200 continues at 206 where the controller 68 monitors the amount of the laundry load within the treating chamber 20 when items are being loaded into the treating chamber 20. At 208, the controller 68 compares the monitored amount with the set amount threshold, which was previously set at 204, to determine when the amount of the laundry loaded into the treating chamber satisfies the set amount threshold. If the monitored amount does not satisfy the set threshold then the controller 68 returns to 206 where the controller 68 continues to monitor the amount of laundry within the treating chamber 20 and then compares it to the set amount threshold at 208 to see if the set amount threshold is satisfied. When it is determined at 208 that the monitored amount satisfies the set amount threshold then a filled condition of the washing machine is determined at 210 by the controller 68. More specifically, the controller 68 may determine from the satisfied amount threshold if the treating chamber 20 is optimally filled. Further, if the set amount thresholds correlate to a percentage (0%, 20%, etc.) of the optimal amount which may be provided in the treating chamber 20 for the selected cycle, then the controller 68 may determine what percent of the treating chamber 20 has been filled.

At 212, the controller 68 may operate the indicator 78 to indicate the determined filled condition to the user. If the set amount threshold is an optimally filled amount for the selected cycle, then indicating the satisfying of the predetermined amount threshold on the user interface at 212 may include visually indicating with the indicator 78 that the treating chamber 20 is optimally filled for the selected cycle. If the set amount threshold is an overfilled amount, then indicating the satisfying of such an amount may include visually indicating with the indicator 78 that the treating chamber is overfilled for the selected cycle. Alternatively, the indication may include illuminating a portion of the range indicator 90 indicating a filled level correlating to the satisfied amount threshold to give the user continuous feedback as the machine is filled. If the set amount range correlates to an optimally filled level then a unique indication may be given to the user when the amount is within the set amount range. Such unique indications may include at least one of a different color, a color in combination with a sound, a graphic, an animation, text, and sequentially displaying text. In this manner the user may be alerted that the laundry located within the treating chamber 20 is within the set amount range for the selected cycle before the user overloads the treating chamber 20.

It is also contemplated that the washing machine 10 may continue to monitor the amount of laundry placed within the treating chamber 20 after an optimally filled condition has been indicated. In this manner the controller 68 may determine an overfilled condition of the treating chamber 20. The indicator 78 and the range indicator 90 may both be used to indicate an overfilled condition for the selected cycle if the user continues to load laundry into the treating chamber 20 beyond the set amount threshold.

A benefit of the method 200 is that the indication provided to the user during loading allows the user to obtain a sense of the actual capacity of the treating chamber and allows the user the ability to optimally fill the treating chamber 20 before starting the cycle of operation. Users often over or under fill the treating chamber 20 and the invention disclosed herein enables information to be given to the user such that the user may add or remove laundry to optimally fill the treating chamber for the selected cycle of operation.

Further, depending on the type of load amount sensor used the sensor may provide additional benefits including that ability to determine how much water is being applied to the laundry machine, which in conjunction with the known load mass may determine a recommended detergent amount. Further, exact knowledge of how much water weight versus fabric weight may be used to determine the type of load. Further, the amount of water remaining in the load may be determined and used during extraction. Further, the determined load amount may be used during the cycle such as to aid in unbalance management and as an input to detect bunching and entanglement. It is also contemplated that a moisture sensor may be used to determine if the laundry loaded into the treating chamber 20 is wet or dry and the moisture content of such laundry. Such a moisture sensor may be operably coupled to the controller 68 such that the controller 68 may receive a signal indicative of the moisture in the laundry and the controller 68 may display on the user interface an indication regarding such moisture content. By way of non-limiting example such an indication may indicate saturated states of the laundry and a potential water to cloth ratio. Further, the controller 68 may be capable of using such moisture information to determine a dry load weight estimated value and operate the indicator 78 accordingly.

Depending on the type of sensor 66 used in the washing machine 10 the output of the sensor 66 may be skewed if either the treating chamber 20 and/or washing machine 10 is not level. Thus, it is contemplated that either of the methods described above may also include an initial sensing of any unlevelness of either the treating chamber 20 and/or the washing machine 10 and adjusting the monitored amount to compensate for any sensed unlevelness. This calibration may occur regardless of whether the determined amount is a weight or a volume. By way of non-limiting example, at the beginning of each method 100 and 200 the levelness of the treating chamber and/or the washing machine 10 may be calculated and if there is an unlevelness, then the controller 68 may calibrate the output of the sensors 66 such that the output of the sensors 66 may be adjusted according to any detected unlevelness.

More specifically, the controller 68 may receive an output signal indicative of the levelness or unlevelness of either the laundry treating appliance and/or the treating chamber from a level sensor 76. The controller 68 may then adjust the output from the sensor 66 according to the output received from the level sensor 76. In this manner, the controller 68 may compensate for any sensed unlevelness in determining the amount of the laundry load in the treating chamber 20. This may allow for the controller 68 to make a more accurate amount determination because the calibrated sensors 66 will provide a more accurate indication of the amount of the laundry in the drum.

With continuing reference to FIGS. 1 and 2, FIGS. 11-18 and the following description are directed to an alternate exemplary embodiment of the invention in which measured laundry load weight and load volume information may be integrated into a signal representing a correlative load size. The load size may be indicated on the user interface 70 generally as previously described herein, and as hereinafter described.

Figure 11B:
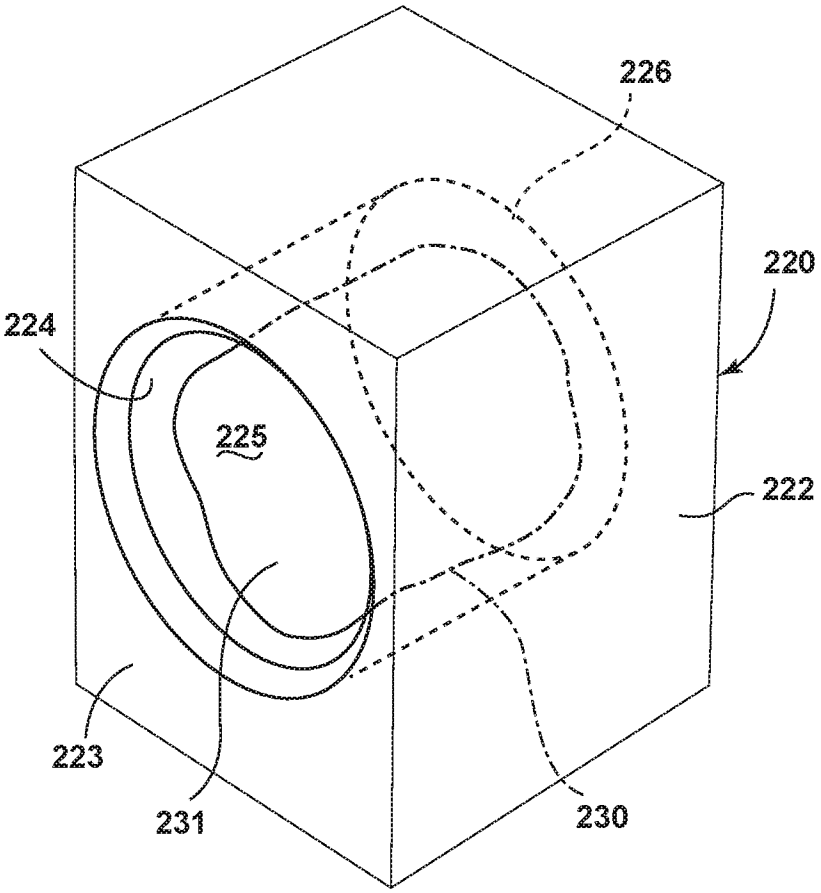
FIGS. 11A and 11B are schematic views of a laundry treating appliance with two differing laundry load distributions, respectively, in a treating chamber.
Figure 11A:
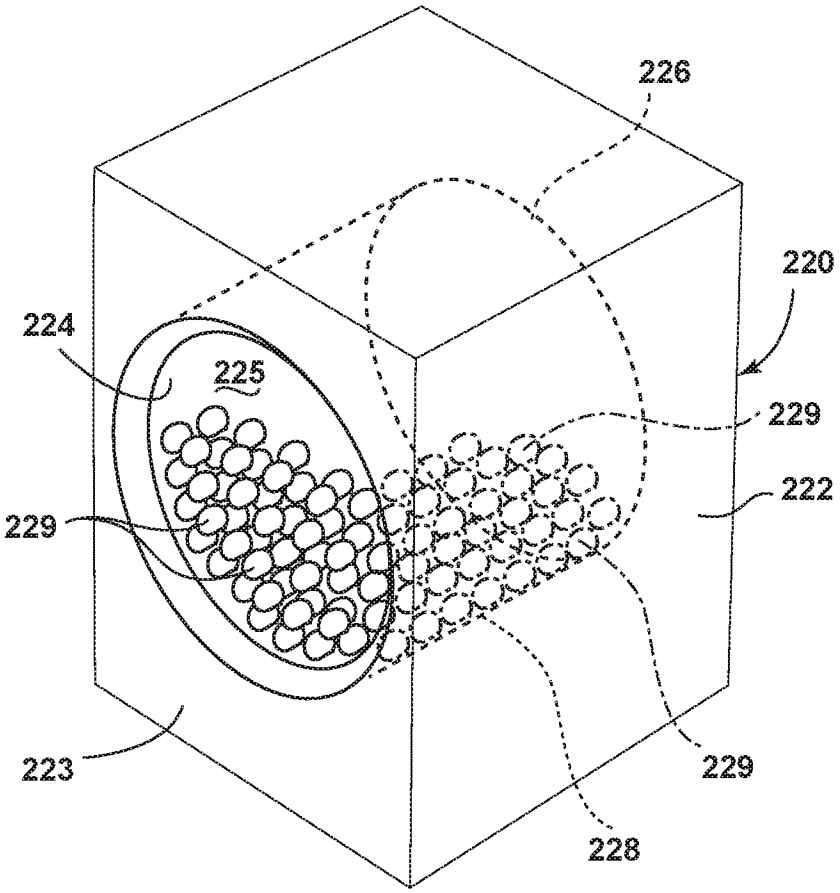

FIGS. 11A and 11B illustrate schematically, a washing machine 220 that may share many features of the washing machine 10 described hereinbefore, which will not be described in detail except as necessary for a complete understanding of the invention. The washing machine 220 may include a cabinet 222 enclosing a drum 226 characterized by an interior treating chamber 225. An obverse wall 223 of the cabinet 222 may include a drum opening 224 enabling access to the interior treating chamber 225. FIG. 11A illustrates a laundry load 228 that may include a plurality of laundry items 229 distributed within the interior treating chamber 225 prior to the initiation of a treating cycle. FIG. 11B illustrates a laundry load 230 that may consist of a single laundry item 231 occupying a substantial portion of the interior treating chamber 225.

As illustrated in FIG. 11A, a plurality of individual laundry items 229 may be loaded into the interior treating chamber 225 so that there is an accumulation of items 229 at the drum opening 224, with the first items 229 loaded into the interior treating chamber 225 distributed somewhat lower in the drum 226 toward the rear of the interior treating chamber 225. By appearing to fill a substantial portion of the interior treating chamber 225, the accumulation of items 229 toward the obverse wall 223 when viewed through the opening 224 may lead a user to overestimate the load size when in actuality the load size may be smaller.

As well, individual laundry items 229 may be distributed along only the bottom of the interior treating chamber 225, and may appear to constitute a relatively small load, which may contribute to an underestimation of the load size. The load 228 may, in fact, be heavy due to, for example, density of the individual items 229, relatively high moisture in the individual items 229, and the like. The low height of the load 228 in the interior treating chamber 225 when viewed through the opening 224 may suggest to a user that the load 228 is lightweight, when in actuality the load may be heavier.

Referring to FIG. 11B, overestimation of the size of a load may also occur with large items 231 such as quilts, down comforters, sleeping bags, pillows, and the like. Such a load 230 may appear to a user to be heavy based upon its occupation of virtually the entire interior treating chamber 225, although in actuality it may be lightweight.

Differences between apparent and actual laundry load sizes may lead a user to override treatment settings to be more consistent with what the user observes. This can lead to inadequacies in the treating process, incorrect dosages of treating chemistry, excess water usage, increased drying time, and other efficiency and cost consequences. Coordinating both weight and volume information for display to a user may lead to an optimization of treating performance and user satisfaction.

A weight determining device, such as the weight sensor 66 of FIG. 1, also referred to as a load sensor, may generate a laundry load weight signal proportional to the weight of the laundry load. The weight sensor 66 may be a load cell, or other sensor responsive to a change in weight of a laundry load as the laundry is loaded into a drum. Alternatively, laundry load weight may be determined based on a motor sensor output, such as an output from a known motor torque sensor (not shown).

Motor torque is a function of the inertia of the rotating drum and laundry load. Inertia sensing may thus utilize motor torque output from a motor torque sensor. Methods exist for determining the load inertia, and thus the load weight, based on motor torque. As an example, inertia may be determined by measuring the torque required to accelerate the laundry load at a constant rate. A resulting inertia value may be input to an algorithm stored in the controller 68 that may provide an estimate of a correlative laundry load weight. The weight signal may be processed by the controller 68 for display on the user interface 70. Regardless of the manner in which a weight signal is generated, the weight signal may be indicative of at least one of the weight, mass, or inertia of the laundry in the treating chamber 225.

It may be understood that the details of the weight sensor 66 are not germane to the present embodiment of the invention, and that any suitable sensor and method may be used to determine the weight of the laundry load. Examples of such weight sensors include, but are not limited to, load cells and strain gages.

A volume determining device may be utilized to generate a laundry load volume signal proportional to the volume of the laundry load in the interior treating chamber 225.

Figure 12:
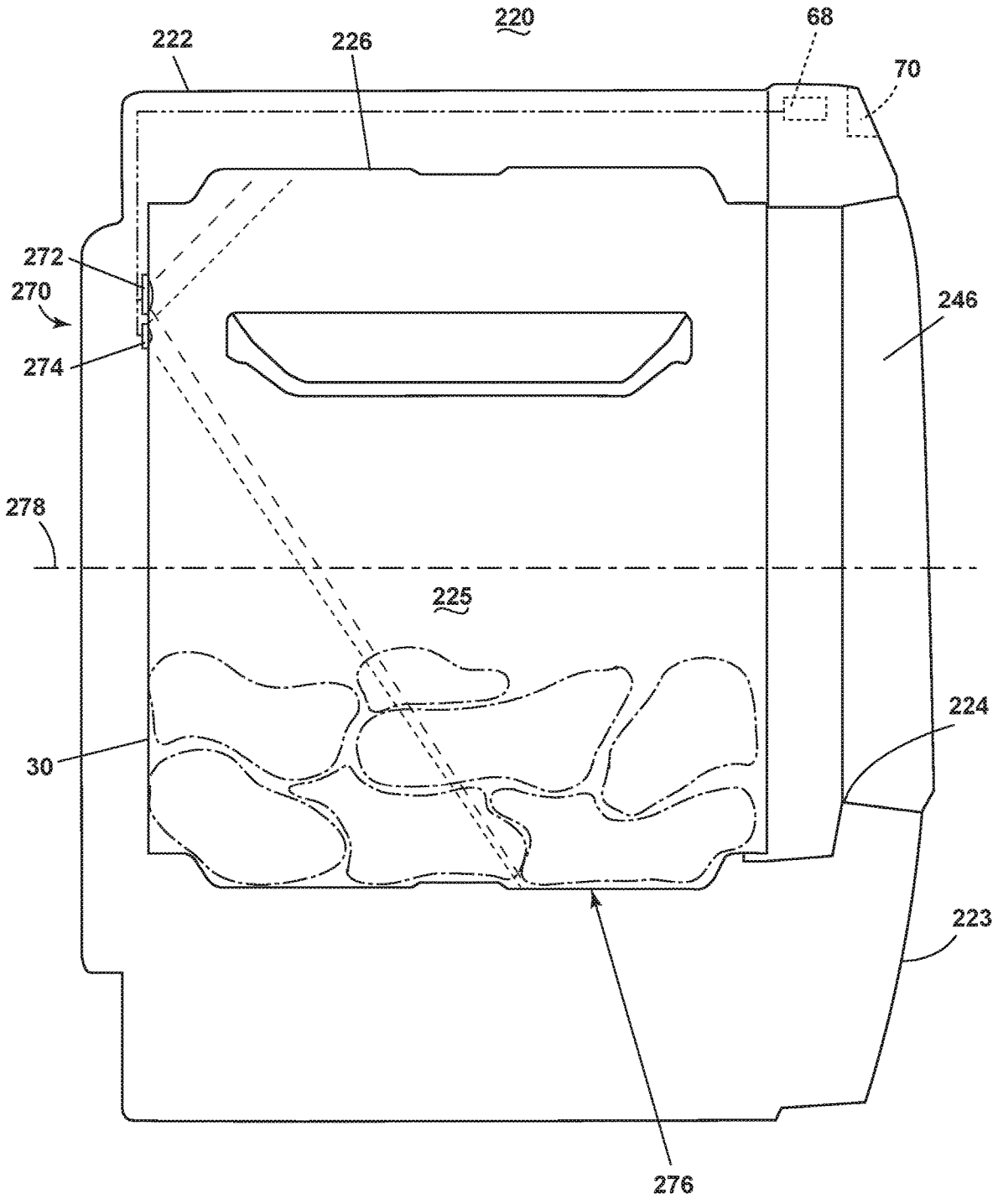
FIG. 12 is a schematic sectional view of a laundry treating appliance according to an embodiment of the invention.

Referring to FIG. 12, the washing machine 220 may include a volume determining device, such as a load volume sensor 270 in communication with the controller 68 for detecting the volume of a laundry load 276 within the treating chamber 225. A single load volume sensor 270 may be capable of capturing two-dimensional or three-dimensional images. Although a single load volume sensor 270 is illustrated, a plurality of sensors 270 may be utilized, for example, to capture two- or three-dimensional images, or to enhance the quality or detail of the images.

In one embodiment, the load volume sensor 270 may consist of an imaging device 272 configured and located for imaging the treating chamber 225 and/or the laundry load 276 within the treating chamber 225. Examples of the imaging device 272 may include an optical sensor capable of capturing still or moving images, such as a camera. One suitable type of camera may be a CMOS camera. Other exemplary imaging devices may include a CCD camera, a digital camera, a video camera, or any other device capable of capturing and transmitting an image.

The imaging device 272 may capture visible and/or non-visible radiation. For example, the imaging device 272 may capture an image in visible light introduced into the interior treating chamber 225. Alternatively, the imaging device 272 may capture an image in non-visible light, such as ultraviolet light. The imaging device 272 may also be a thermal imaging device capable of detecting radiation in the infrared region of the electromagnetic spectrum.

The imaging device 272 may be placed in a suitable location to view the treating chamber 225, based upon the structure of the washing machine 220 and the position that enables the capture of an image having optimal quality. For example, the imaging device 272 may be located in the drum 226 on a suitable drum surface, incorporated into a mounting structure such as a portion of the cabinet 222, washing machine framework, or suitably integrated attachment point, or in the door 26. A plurality of imaging devices 272 may be incorporated into the radially inward edges of the baffles 28 to capture images of the laundry load in the drum 226. Information from the imaging device 272 may be processed in the controller 68 by utilizing an algorithm to produce a metric relating to volume, height, or level of the laundry load.

Figure 13:
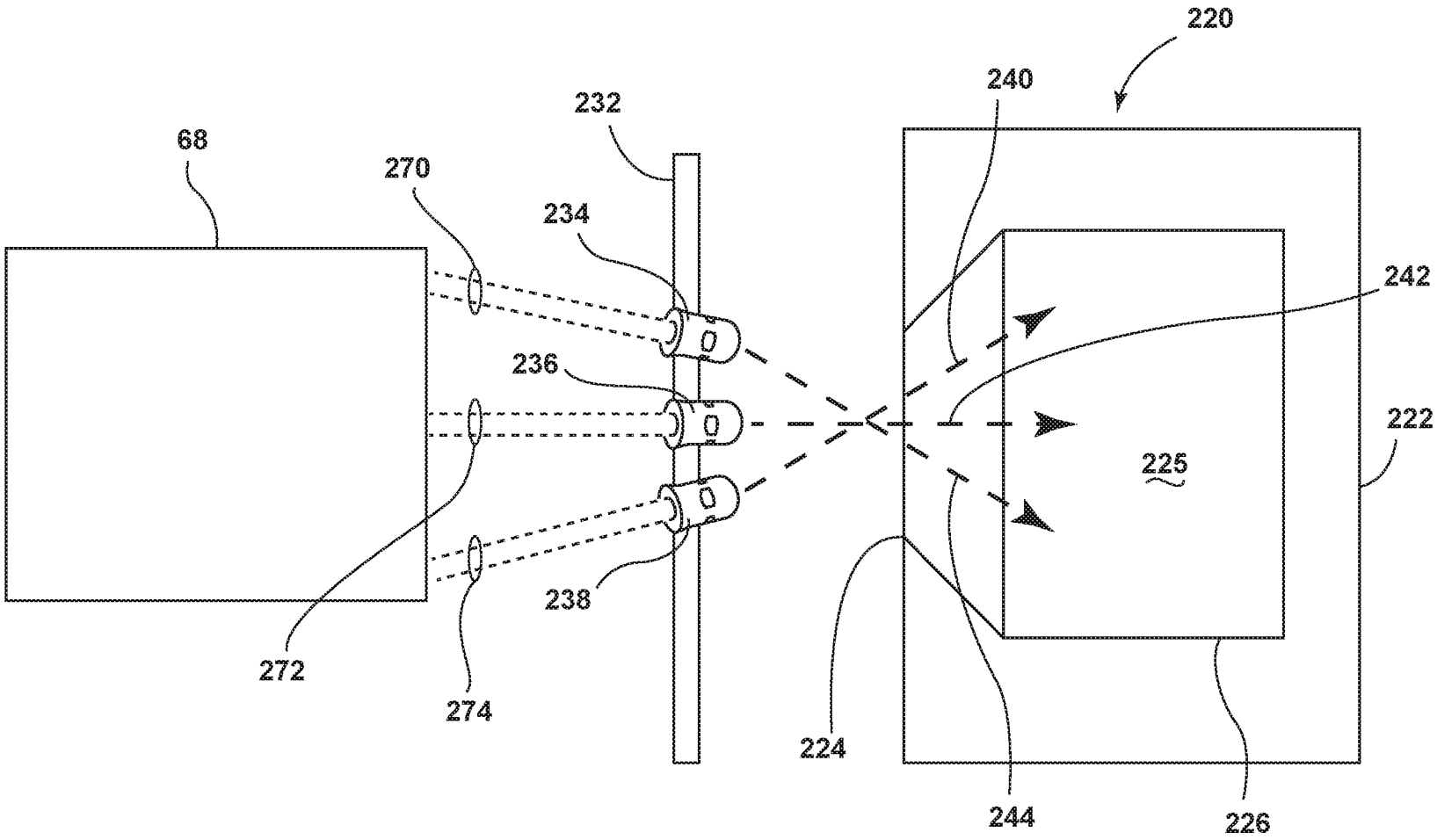
FIG. 13 is a schematic sectional view of a laundry treating appliance, light emitting diodes, and a controller according to an alternate embodiment of the invention.

The load volume sensor 270 may include an illumination source 274 to aid the imaging device 272. The type of illumination source 274 may vary. For example, the illumination source 274 may be a known incandescent appliance or washer light bulb used to illuminate the treating chamber 225. Alternatively, as illustrated in FIG. 13, one or more LEDs may be used in place of an incandescent bulb. Optical or infrared reflective sensing, based upon measuring the reflectance, for example, of an optical laser, may also be utilized.

Image analysis may be used to isolate the laundry load 276 from other structures in the image, such as the drum 226, or baffles 28, and determine the volume of the laundry load. A suitable analytical method may be employed to determine the volume of the laundry load from the images. Alternatively, sensors (not shown) that may generate an electrical signal when contacted by a laundry item may be installed in the drum 226, for example as an array integrated into the rear wall of the drum 226, or into the rear wall and side wall. As the drum 226 is loaded, some of the sensors may be contacted by laundry items, generating signals corresponding to laundry locations. The signals may be processed in the controller 68 by utilizing an algorithm to produce a volume metric. The volume metric may be indicative of at least one of the volume, level, or height of the laundry load in the treating chamber 225.

It may be understood that the details of the load volume sensors are not germane to the present embodiment of the invention, and that any suitable sensor and method may be used to determine the volume of the laundry load.

As illustrated in FIG. 13, an exemplary plurality of LEDs 234, 236, 238 may be arranged so that light emitted by the LEDs may be directed into the interior treating chamber 225. The LEDs 234, 236, 238 may be mounted in or on a mounting element 232, which may be a front wall of the cabinet 222, the door 25, the bellows 26, the baffles 28, or other surfaces. The forgoing description is directed toward the LEDs as an illumination source. The LEDs may alternatively be part of a load volume sensor 270.

The first LED 234 may transmit a first light ray 244 into the interior treating chamber 225 in a generally downward orientation. The second LED 236 may transmit a second light ray 242 generally parallel with the rotational axis of the drum 226 illustrated in FIG. 12. The third LED 238 may transmit a third light ray 240 into the interior treating chamber 225 in a generally upward orientation. Increasing the number of LEDs, and/or positioning the LEDs in a suitable pattern, may provide for light ray transmissions that effectively penetrate the interior treating chamber 225.

Each LED may be matched with a reflection element (not shown) positioned at a suitable location within the interior treating chamber 225, such as on the rear wall of the drum 226. A plurality of reflection elements and/or light sensors (not shown) may be positioned to intercept individual light beams having a narrow beam divergence. For example, a light beam may be directed to a portion of the drum 226, to be reflected from a reflective surface (not shown) to a light sensor (not shown), or received directly by a light sensor. If a large number of LEDs is utilized, the reflection elements may also be distributed over the drum sidewall. Alternatively, the drum 226 may be fabricated of a stainless steel, thereby providing a reflection surface encompassing the entire drum. The reflection elements or reflection surface may reflect the light rays to a plurality of sensors, such as known optical sensors, that may be operably coupled with the controller 68. The controller 68 may process electrical signals from the sensors into information concerning the volume of laundry in the interior treating chamber 225. The controller 68 may be programmed to utilize an algorithm for converting the various data signals into a load size.

The LEDs, or a bundle of LEDs (not shown), may produce different colors to correspond with different load sizes. For example, an LED utilized for illumination and producing white light may also be utilized for load size and producing colored light. Other combinations of LEDs for illumination and load size indication may be utilized.

It is anticipated that the load size as presented to a user may be qualitative rather than quantitative. Thus, for example, load sizes may be identified as "small, medium, large, or extra-large." Quantitative load sizes may be expressed as a percent of interior treating chamber volume, or as an absolute volume in cubic inches, liters, and the like, calculated from the load weight and load volume information generated from the sensors.

The LEDs may be hardwired to the controller 68 through suitable electrical leads. Alternatively, the LEDs may be adapted for wireless communication with the controller 68.

The signals from the one or more weight determining devices 66 and the one or more volume determining devices 270 may be processed in the controller 68 into a qualitative load size that can be indicated on the user interface 70. An example of a qualitative load size range may be "extra small, small, medium, large, extra-large." Alternatively, an example of a quantitative load size range may be "0, 2.5, 5.0, 7.5, 10.0," each numeral in units of weight. Determining a qualitative load size metric may comprise making a determination that may be different from what would be determined based on only one of a weight signal or a volume signal, particularly for the "low volume/high mass" and "high volume/low mass" conditions described with respect to FIGS. 11A and 11B. For example, relying solely on information from a weight determining device may indicate a laundry load having little weight. However, the absence of volume information from a volume determining device may leave a user's observations of the laundry load in the treating chamber as the only indicator of volume. This may induce the user to select a wash liquid level, detergent amount, cycle duration, and the like, for a load size that is inaccurate based upon an observed volume. Furthermore, a qualitative load size range may provide meaningful information to a greater number of users because it may correlate with a user's observations of load size more closely than quantitative weight or volume numerical values.

Figure 14:
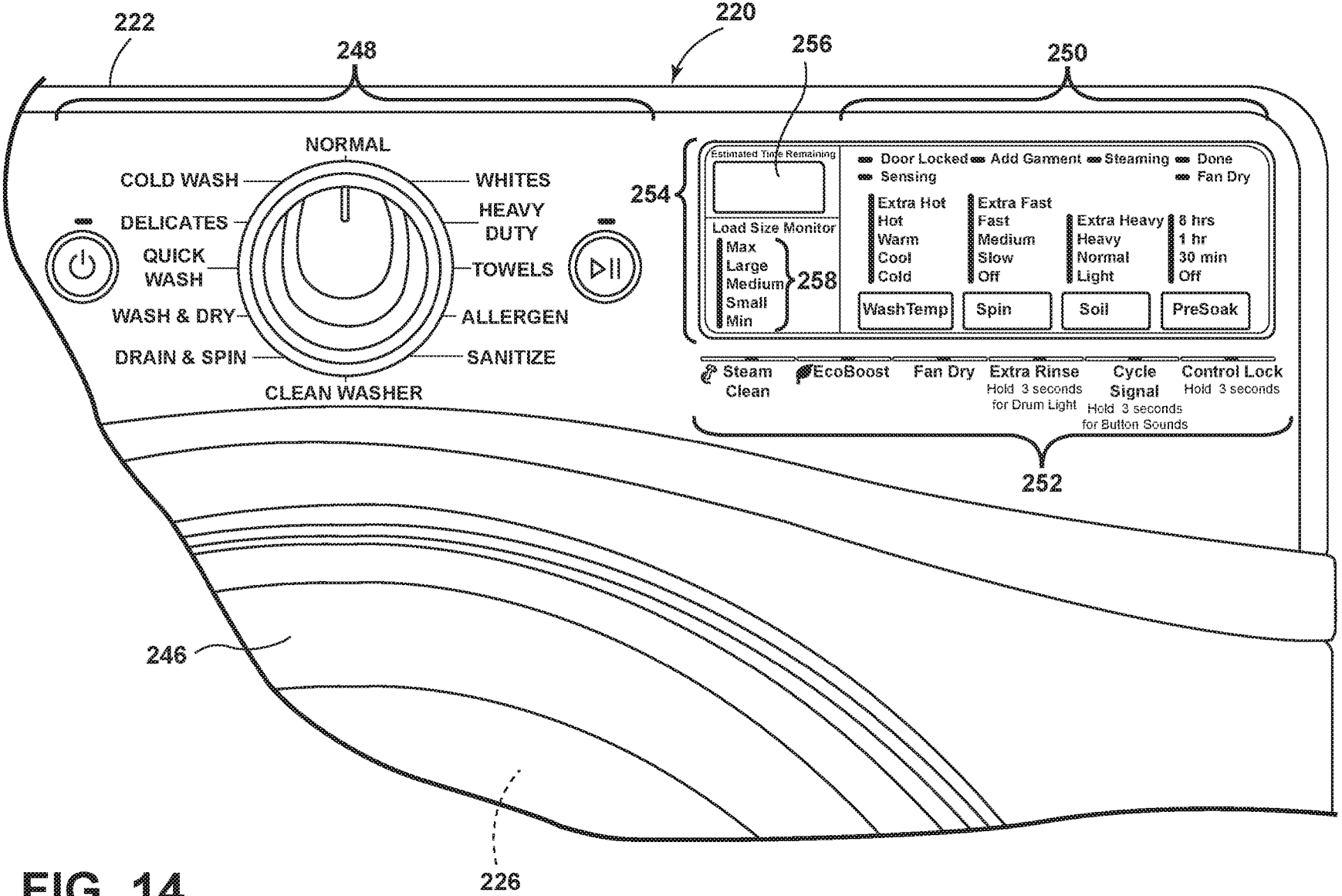
FIG. 14 is a partial elevation view of a portion of a user interface for a laundry treating appliance according to another embodiment of the invention.

FIG. 14 illustrates a portion of a user interface of an exemplary washing machine 220. The user interface 70 may include a treating cycle control 248 for selecting a desired treating cycle. Adjacent the treating cycle control 248 may be a cycle modification control 250, a supplemental treatment control 252, and a time/size module 254. The time/size module 254 may include a cycle time display 256 and a load size monitor 258. The cycle time display 256 may show the estimated time remaining for a current treating cycle. The load size monitor 258 may show the qualitative load size based upon measurements obtained from the weight determining device and the volume determining device.

Figure 15:
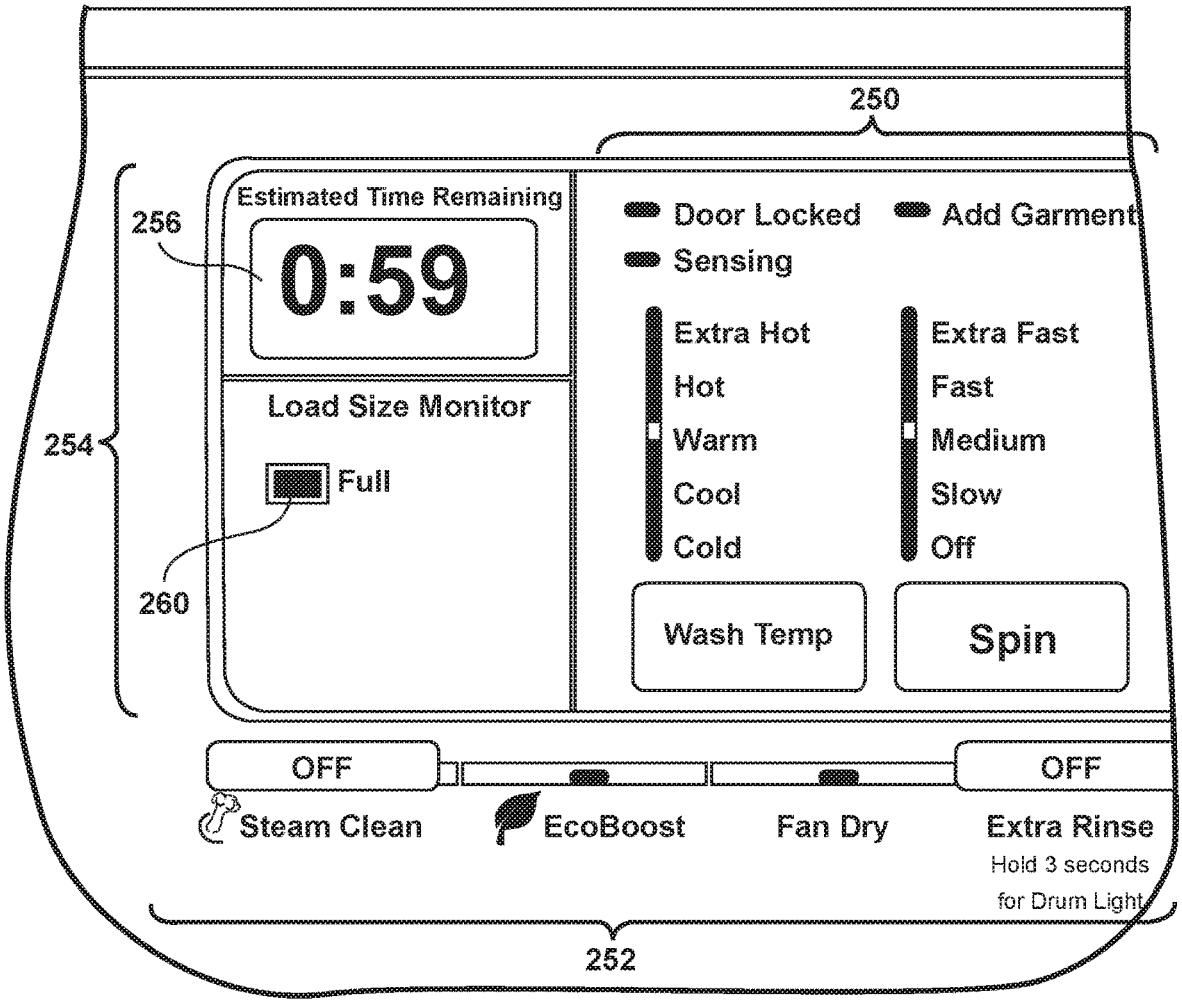
FIG. 15 is an enlarged elevation view of a portion of the user interface illustrated in FIG. 14 showing a first embodiment of a load size indicator.

FIG. 15 illustrates an alternate embodiment of the time/size module 254 comprising a FULL indicator 260. The FULL indicator 260 may be a light that is turned on when the interior treating chamber 225 holds a full laundry load based upon signals from the weight determining device and the volume determining device. Until the laundry load reaches a full condition, the light may remain off. Alternatively, the light may change color as the laundry load is placed in the treating chamber 225. For example, initially the light may shine green, becoming yellow as the treating chamber 225 is filled, and transitioning to red when the treating chamber 225 is full.

Should a user continue placing laundry into the treating chamber 225 after the FULL indicator 260 indicates a full load, one or more of several modifications to the selected treating cycle may be made. For example, the treating cycle may be extended, which may be reflected in a change in the output from the cycle time display 256. Additional treating chemistry and/or wash liquid may be used, wash liquid temperature may be modified, spin performance may be changed, such as a higher speed or longer spin duration, an extra rinse may be utilized, and the like.

Figure 16:
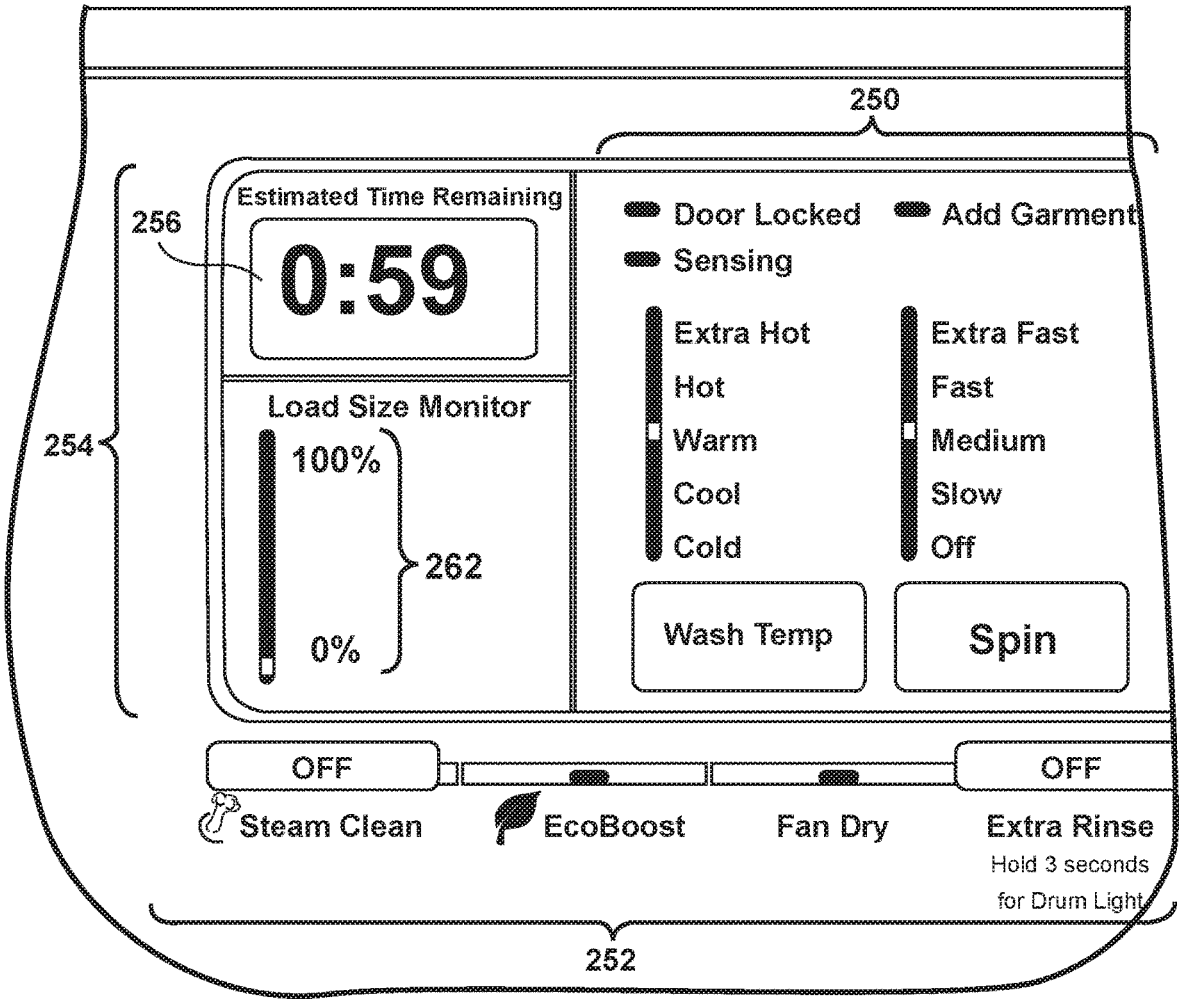
FIG. 16 is an enlarged elevation view of a portion of the user interface illustrated in FIG. 14 showing a second embodiment of a load size indicator.

FIG. 16 illustrates an alternate embodiment of the time/size module 254 in which the FULL indicator 260 may be replaced with a quantitative load size scale 262. The load size scale 262 is illustrated with load size values that may range from 0% to 100% of designated capacity. Alternatively, actual values, such as actual laundry load weight or actual laundry load volume, may be utilized. As with the FULL indicator 260, should the capacity of the treating chamber 225 be exceeded, this may be reflected in a change in the output from the cycle time display 256, and/or one or more modifications to the selected treating cycle may be made as described above.

As with the FULL indicator 260, the quantitative load size scale 262 may only inform the user of the size of the laundry load, and when it has been exceeded. The user may be unable to control any aspect of the selected treating cycle other than removing laundry items until the load size is no greater than the designated capacity.

Figure 17:
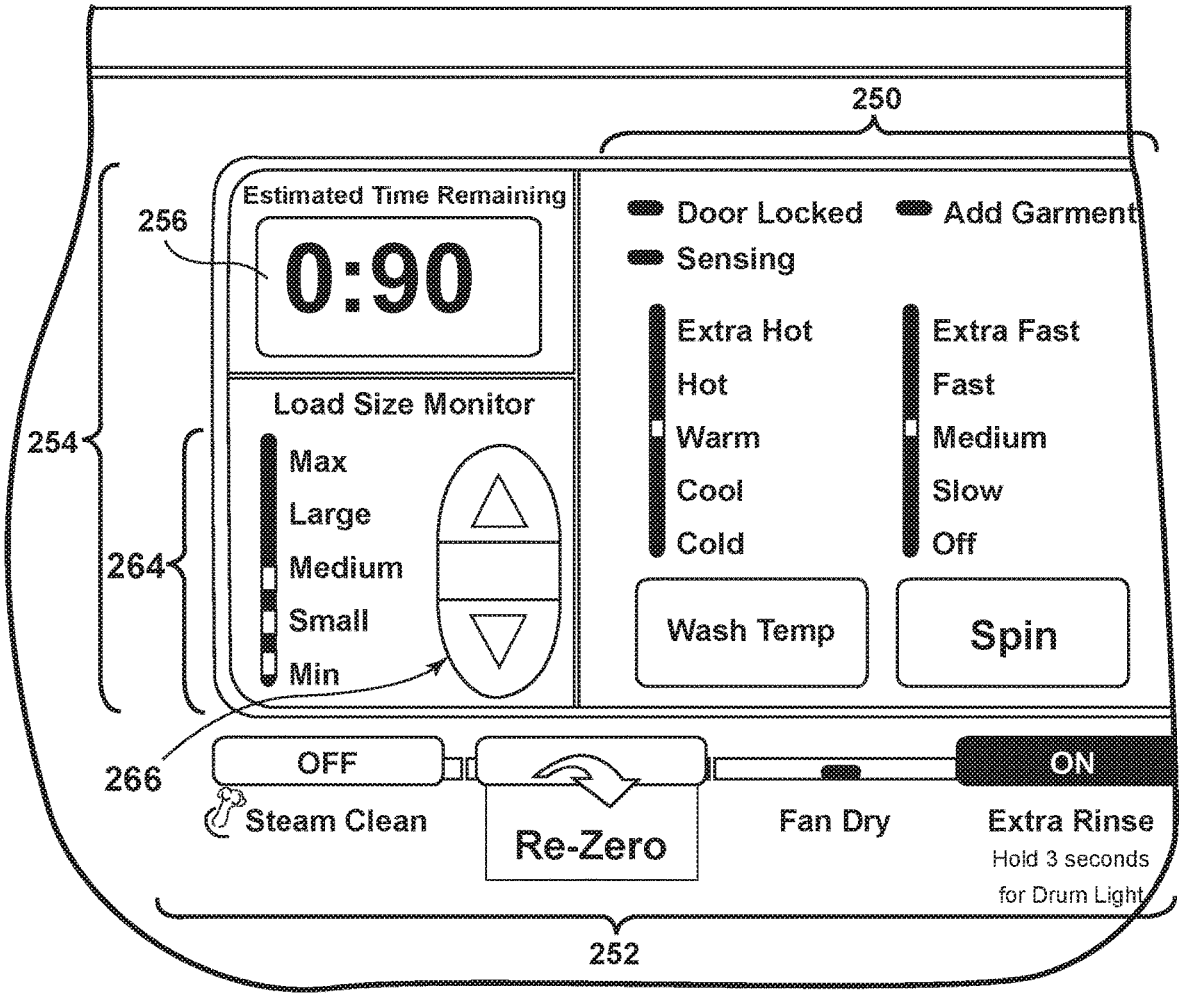
FIG. 17 is an enlarged elevation view of a portion of the user interface illustrated in FIG. 14 showing a third embodiment of a load size indicator.

FIG. 17 illustrates an embodiment of the time/size module 254 in which a qualitative load size scale 264 may be utilized. A load size adjustment control 266 may also be part of the time/size module 264, and may be utilized to adjust cycle time, load size, and other factors based upon the load weight and load volume signals processed in the processor 68.

The qualitative load size scale 264 may indicate load sizes identified as "minimal, small, medium, large, and maximum." Alternatively, the load sizes may be identified as "extra small, small, medium, large, and extra-large." It may be anticipated that at least three of a range of five qualitative load sizes may be available for any load size scale.

In yet another embodiment, the controller 68 may receive a weight signal reflecting an input to the user interface 70 from a user. For example, the load size adjustment control 266 may be used for such an input. During loading of the washing machine 220, the user may adjust the load size by using the load size adjustment control 266 to indicate a change in the load size automatically determined from the signals from the weight determining device and volume determining device. In effect, the input from the load size adjustment control 266 may be processed in the controller 68 as a signal from a weight determining device, and may override the weight signal actually generated by a weight determining device.

Alternatively, the user may disable the automatic weight determination function, and input a weight value utilizing the load size adjustment control 266 to set a load size. The cycle time display 256 and/or load size monitor 258 may be utilized by the user to indicate a qualitative load size during the laundry loading process.

The controller 68 may receive a volume signal reflecting an input to the user interface 70 from a user. The load size adjustment control 266 may be used for such an input. During loading of the washing machine 220, the user may adjust the load size by using the load size adjustment control 266 to indicate a change in the load size automatically determined from the signals from the weight determining device and volume determining device. In effect, the input from the load size adjustment control 266 may be processed in the controller 68 as a signal from a volume determining device, and may override the volume signal actually generated by a volume determining device.

FIG. 18 illustrates in tabular form an arrangement of washing machine performance factors that may be correlated with exemplary loading types. Selected combinations of load mass and load volume may generate load sizes, and recommended wash liquid levels and detergent quantities that may be displayed on the user interface 70. This tabular arrangement may be stored in computer memory 72 in the controller 68 for use during an analysis of information transmitted from a weight determining device and a volume determining device.

For example, a user may recognize that a laundry load consists of a down comforter. Output from a weight determining device may correctly indicate a low laundry load weight. However, observation of the volume of the load in the drum 226 may confuse the user as to the quantity of wash liquid and detergent to use. Depending upon the relative significance to the user of the weight and volume information, the user may select quantities of wash liquid and/or detergent to be used. The quantities selected by the user may be inappropriate for the comforter, leading to dissatisfaction with the treating cycle results, the need to repeat the treating cycle, the wasting of electricity, wash liquid, and detergent, and a continuing uncertainty over the quantities of wash liquid and detergent required for the comforter and similar laundry loads.

However, utilizing the method described herein, both the weight determining device and the volume determining device may appropriately characterize the load as having low mass and high volume. Consequently, the wash liquid and detergent quantities may be adjusted to provide an optimal treating cycle at the lowest cost.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a rotatable drum at least partially defining a treating chamber into which laundry may be placed for treatment according to a cycle of operation;

a processor programmed to at least:

as the laundry is being placed in the treating chamber, at least one of measure, sense, analytically determine, estimate, or receive as an input a first load size of the laundry in the treating chamber to define a determined first load size;

select a predetermined intensity corresponding to the determined first load size to define a selected first light setting; and control a single LED to illuminate with the selected first light setting, the single LED configured to display at least a first intensity while illuminated and a second intensity while illuminated.

2. The laundry treating appliance of claim 1 wherein the processor is further programmed to:

as the laundry continues to be placed in the treating chamber, at least one of measure, sense, analytically determine, estimate, or receive as an input a second load size of the laundry in the treating chamber to define a determined second load size;

select an other predetermined intensity based on the determined second load size to define a selected second light setting; and control the single LED to illuminate with the selected second light setting.

3. The laundry treating appliance of claim 2 wherein the processor is programmed to select the second light setting to be different from the first light setting when the determined second load size is different from the determined first load size.

4. The laundry treating appliance of claim 2 wherein the processor is further programmed to adjust an audible signal being output based at least on one of the determined first load size or the determined second load size.

5. The laundry treating appliance of claim 2 wherein the processor is further configured to determine a filled condition of the treating chamber, as indicated by the first light setting, and an overfilled condition of the treating chamber, as indicated by the second light setting.

6. The laundry treating appliance of claim 1 wherein the processor being programmed to determine a first load size comprises the processor being programmed to determine the first load size based on a weight of the laundry within the treating chamber.

7. The laundry treating appliance of claim 1 wherein the single LED is controlled to illuminate with the selected first light setting while laundry is being placed in the treating chamber.

8. The laundry treating appliance of claim 1, further comprising a second indicator comprising a graduated scale indicator and wherein the processor is further configured to control the second indicator based on the determined first load size.

9. The laundry treating appliance of claim 1 wherein the single LED does not form a portion of a graduated scale.

10. A method of operating the laundry treating appliance of claim 1, the method comprising:

determining, via the processor, a load size of the laundry in the treating chamber as the laundry is being placed in the treating chamber;

selecting, via the processor, an intensity corresponding to the determining the load size to define a light setting;

controlling the single LED to illuminate with the selected light setting; and repeatedly determining, selecting, and controlling an intensity of the light setting corresponding to the determining the load size in the treating chamber.

11. The method of claim 10, further comprising determining the amount of laundry based on a volume of the laundry present in the treating chamber.

12. The method of claim 10, further comprising as the laundry is being placed in the treating chamber, repeatedly adjusting an audible signal being output based on the amount of laundry.

13. The method of claim 12 wherein the audible signal is a non-silent signal when the treating chamber is overfilled for a selected cycle of operation, and the audible signal is a silent signal when the treating chamber is not overfilled for a selected cycle of operation.

14. A laundry treating appliance, comprising:

a rotatable drum at least partially defining a treating chamber into which laundry may be placed for treatment according to a cycle of operation;

a processor programmed to at least:

as the laundry is being placed in the treating chamber, at least one of measure, sense, analytically determine, estimate, or receive as an input a first load size of the laundry in the treating chamber to define a determined first load size;

select a predetermined color corresponding to the determined first load size to define a selected first light setting; and control at least one LED to illuminate with the selected first light setting; and control a second indicator, comprising a graduated scale indicator, based on the determined first load size.

15. The laundry treating appliance of claim 14 wherein the processor is further programmed to:

as the laundry continues to be placed in the treating chamber, at least one of measure, sense, analytically determine, estimate, or receive as an input a second load size of the laundry in the treating chamber to define a determined second load size;

select an other predetermined color based on the determined second load size to define a selected second light setting; and control the at least one LED to illuminate with the selected second light setting.

16. The laundry treating appliance of claim 14 wherein the at least one LED is a multi-color LED configured to display at least a first color while illuminated and a second color while illuminated.

17. The laundry treating appliance of claim 14 wherein the at least one LED comprises an LED array.

18. The laundry treating appliance of claim 14 wherein the at least one LED comprises a plurality of LEDs.

* * * * *